United States Patent [19]

Moriarty

[11] Patent Number: 4,517,165

[45] Date of Patent: May 14, 1985

[54] COMBUSTION METHOD

[75] Inventor: Michael P. Moriarty, Simi Valley, Calif.

[73] Assignee: Rockwell International Corporation, El Segundo, Calif.

[21] Appl. No.: 344,067

[22] Filed: Feb. 2, 1982

Related U.S. Application Data

[63] Continuation-in-part of Ser. No. 239,943, Mar. 3, 1981, abandoned.

[51] Int. Cl.[3] ..... B01J 8/00

[52] U.S. Cl. ..... 423/244; 423/235; 431/2; 431/4; 431/10; 110/342; 110/344; 110/345; 110/347

[58] Field of Search ..... 423/168, 244 A, 561 R, 423/235; 110/347, 345, 245; 431/2, 4, 10

[56] References Cited

U.S. PATENT DOCUMENTS

| | | | |
|---|---|---|---|
| 3,599,610 | 8/1971 | Spector | 423/244 A |
| 3,717,700 | 2/1973 | Robison et al. | 110/345 |
| 3,941,552 | 3/1976 | Cottell | 110/347 |
| 4,011,299 | 3/1977 | Henis et al. | 423/244 A |
| 4,013,399 | 3/1977 | Craig et al. | 431/10 |
| 4,021,188 | 5/1977 | Yamagishi et al. | 431/10 |
| 4,102,277 | 7/1978 | Wall | 110/245 |
| 4,168,670 | 9/1979 | Wall et al. | 110/245 |
| 4,250,820 | 2/1981 | Lautenschlager | 431/10 |
| 4,256,703 | 3/1981 | Dixit et al. | 110/345 |
| 4,259,911 | 4/1981 | Jones | 122/40 |
| 4,285,283 | 8/1981 | Lyon et al. | 431/10 |
| 4,292,953 | 10/1981 | Dickinson | 110/345 |
| 4,381,718 | 5/1983 | Carver et al. | 110/347 |

*Primary Examiner*—John Doll
*Assistant Examiner*—Jackson Leeds
*Attorney, Agent, or Firm*—H. Fredrick Hamann; Harry B. Field

[57] ABSTRACT

A method and apparatus for combustion of a sulfur-containing fuel which substantially reduces the amount of gaseous sulfur compounds which would otherwise be emitted.

A source of oxygen, a sulfur-containing fuel, and an inorganic alkaline absorbent are reacted under controlled conditions of temperature, stoichiometry, and residence time whereby the inorganic alkaline absorbent reacts with the fuel sulfur to form a mixture of combustion products and desired solid sulfur compounds, the latter being readily removed utilizing conventional filtration equipment. In a preferred embodiment of the invention, the mixture of fuel and combustion products is passed into a nitrogenous compound destruction zone wherein, under controlled conditions, the concentration of nitrogenous compounds present are reduced to a desired level.

11 Claims, 4 Drawing Figures

COMBUSTION METHOD

This application is a continuation-in-part of application Ser. No. 239,943 filed Mar. 3, 1981 now abandoned.

BACKGROUND OF THE INVENTION

1. Field of the Invention

The present invention relates to the combustion of sulfur-containing fuels so that minimal emission of gaseous sulfur compounds occurs. It particularly relates to the substantially complete combustion of sulfur-containing carbonaceous and hydrocarbon fuels so that substantially reduced emission of gaseous sulfur compounds occurs.

2. Background Art

Within the past few years there has been an increasing concern with the immediate and long-term problems resulting from the ever-increasing pollution of the atmosphere. With this concern has come an awareness at all levels that steps must be taken to halt the increasing pollution and, if at all possible, to reduce the present pollution levels. As a result of this awareness, a substantial amount of money and effort is being spent by business and governmental agencies to develop standards and measures for preventing significant discharge of pollutants into the atmosphere. Among the pollutants of concern are the various oxides of nitrogen and gaseous sulfur compounds present in the waste gases discharged from many refining and chemical plants and the flue gases from power plants which generate electricity by combustion of fossil fuels. A predominant form of nitrogen oxide released to the atmosphere is nitric oxide (NO) which, upon release into the atmosphere, comes into contact with oxygen and can react therewith to form nitrogen dioxide ($NO_2$) or any of the other numerous oxides of nitrogen, many of which are known to be toxic to both plant and animal life. The gaseous sulfur compounds may be present in many forms, such as $H_2S$, COS, $SO_2$, and the like. These gaseous compounds are released into the atmosphere, come into contact with oxygen and moisture, and can react to form sulfuric acid, resulting in the so-called "acid rains", known to be detrimental to both aquatic and plant life.

Principally, three approaches have been utilized in attempts to reduce the emission of gaseous sulfur compounds. They are (1) removal of the sulfur constituents from the fuel prior to its combustion or partial combustion, (2) use of an additive to react with the sulfur during combustion, and (3) scrubbing of the gaseous effluent to remove the sulfur constituents prior to its release into the atmosphere. To obtain substantially complete removal of the sulfur constituents prior to combustion requires the use of expensive solvents for extraction of the sulfur components, which also extract a significant fraction of the fuel energy. Such methods have not proven to be altogether satisfactory in view of both cost and effectiveness. The predominant method now practiced for removal of the sulfur constituents comprises scrubbing the effluent gases with an absorbent for removal of the sulfur constituents prior to discharging the gases into the atmosphere. A disadvantage with this approach, however, is the high capital and operating costs involved in treating the large volumes of effluent gas to remove the small quantity of dispersed gaseous sulfur components. Indeed, for an average utility power plant, the cost of a facility for treating the effluent gas can be in excess of $100 million.

Much effort has been directed to attempting to react the sulfur compounds present in the fuel with an additive to form solid compounds during the combustion process. Advantages of this approach are that: (1) the absorbent can be placed in more intimate contact with the fuel sulfur compounds and, therefore, the absorbent treats a higher concentration of these sulfur compounds; (2) the capture of the fuel sulfur in a solid, easily removable form is accomplished in existing equipment, the burner; and (3) the solid sulfur compounds can then be removed by existing filtration equipment, which is normally used for the removal of the ash constituents of the fuel. The principal disadvantage of this approach heretofore has been that excessive amounts of absorbent had to be added to the fuel to obtain a high percentage of removal of the sulfur constituents of the fuel. Indeed, most of the literature suggests that a molar ratio of absorbent to sulfur of at least 3 or higher is necessary to remove 70% or more of the sulfur.

Much effort has also been directed to retaining the solid sulfur compounds as solids throughout the remainder of the combustion process. The literature indicates that, although gaseous sulfur compounds are thermodynamically favored over the solid forms at normal combustion stoichiometry and temperatures, nearly all experiments show that some fraction of the solid forms survive the combustion process. (See G. Flament, "Direct Sulphur Capture in Flames Through the Injection of Sorbents", Int'l Flame Res. Fdtn. Doc. nr. G 19/a/9, Nov. 1980.) In most cases, about half of the fuel sulfur survives the entire combustion process in the solid form, and some experiments have shown considerably higher retention.

Obviously, there still exists a need for an improved method and apparatus for the combustion of sulfur-containing fuels which would permit a reduction in excess of 70% and preferably in excess of 90% of the gaseous sulfur compounds which would otherwise be emitted and which would not require the use of a large excess of absorbent.

SUMMARY OF THE INVENTION

The present invention provides a method utilizing one or more zones for the combustion of fuels whereby minimal quantities of gaseous sulfur compounds are present in the resulting effluent gases.

Broadly, the present invention comprises reacting a sulfur-containing fuel in a first combustion zone with from about 25% to 40% of the total stoichiometric amount of oxygen required for complete combustion of the fuel in the presence of an inorganic alkaline absorbent under selected conditions of temperature and residence time. The fuel and oxygen react to release the sulfur constituents of the fuel and form combustion products containing gaseous sulfur compounds. The resultant mixture of fuel, combustion products, gaseous sulfur compounds and inorganic alkaline absorbent is maintained at a temperature of from about 1000° to 1800° K. for a sufficient residence time so that a desired amount of the gaseous sulfur compounds react with the inorganic alkaline absorbent to form solid sulfur compounds. The minimum residence time required for gasification and sulfur capture is a total of from about 50 to 600 milliseconds. Thereby, the mixture discharged from this first combustion zone has a substantially reduced emission of gaseous sulfur compounds compared with those that would otherwise be present as a result of conventional combustion.

For most applications a temperature range from about 1200°0 to 1600° K. is preferred and may be required. Thus, certain fuels cannot ordinarily be gasified within practical time limits in an entrained flow combustor at temperatures below 1200° K. Also, while more rapid gasification will occur at temperatures about 1600° K., such higher temperatures require the use of costly high-temperature-resistant materials of construction. Also, some inorganic alkaline absorbents lose their effectiveness at these higher temperatures.

Practice of the present invention effectively controls emission of gaseous sulfur compounds while substantially reducing the quantity of inorganic alkaline absorbent required for reaction with the fuel sulfur constituent to form a more stable solid sulfur compound which can be retained in solid form throughout the remainder of the combustion process. This can readily be removed from the effluent gases by conventional filtration equipment.

A key feature of the invention is the manner in which fuel sulfur is efficiently captured in the solid form by utilizing controlled conditions of air/fuel stoichiometry, temperature, and residence time. In contrast to other approaches in which gaseous sulfur control was attempted through the introduction of an alkaline absorbent in large quantities, in accordance with the present invention it has been found that, under certain controlled conditions, substantially less inorganic alkaline absorbent is required to achieve substantial capture.

A second key feature of the invention is the manner in which air/fuel stoichiometry, temperature, and residence time are controlled to ensure that, once captured, the fuel sulfur constituent remains in a solid form throughout the remainder of the combustion proccss. In contrast to other approaches, which consider only the chemistry and chemical kinetics of oxidation and dissociation of the solid sulfur compounds, this invention also considers the chemical, physical, and thermal properties of the solid particle to ensure its retention in the solid form.

The present invention is based partly upon the discovery that the air/fuel mixture stoichiometry has a significant effect on the reaction which takes place between fuel sulfur and an inorganic alkaline absorbent in intimate contact with the fuel. Specifically, it has been found that within a certain narrow range of air/fuel stoichiometry during combustion, the reaction between the inorganic alkaline absorbent and any fuel sulfur constituent is quite rapid and efficient, such that the molar ratio of the absorbent to fuel sulfur constituent can be in a range as low as from about 1:1 to 3:1, while still obtaining 90% or more capture of the fuel sulfur constituents present.

In practicing the invention, a combustible fuel, an oxygen-containing gas, and an inorganic alkaline absorbent for fuel sulfur constituent are introduced into a first combustion sulfur capture zone. Preferably, the oxygen-containing gas is air and is introduced in an amount to provide from about 25% to 40%, and preferably 32% to 37%, of the oxygen requirements for complete combustion of the fuel. The combustible air/fuel mixture will react to form combustion products, and the inorganic alkaline absorbent will react with the fuel sulfur constituent to form the desired, solid sulfur compounds. The resultant combustion mixture is maintained at a temperature of from 1000° to 1800° K. for a time sufficient to complete the absorbent-sulfur reactions, thereby reducing the concentration of the gaseous sulfur compounds to a desired level. Subsequently, the solid sulfur compounds can readily be removed from the combustion mixture by conventional filtration techniques.

In accordance with a particularly preferred embodiment of the present invention, the mixture of fuel and combustion products discharged from the sulfur capture zone is passed into a nitrogenous compound destruction zone. More particularly, as taught in copending application Ser. No. 178,210, filed Aug. 14, 1980, which issued Jan. 24, 1984 as U.S. Pat. No. 4,427,362 and assigned to the assignee of the present invention, it is reported that during the initial combustion of fuel, nitrogenous compounds are formed; and an apparatus and method are disclosed therein for the destruction of such compounds. In accordance with that invention, a fuel-rich mixture of combustion products, or fuel alone, and an oxygen-containing gas, preferably air, are introduced into a nitrogenous compound destruction zone, the total air in the zone being controlled to provide from about 45% to 75%, and preferably from about 50% to 65%, of the oxygen requirements for combustion of the fuel. The overall mixture of fuel and air react to form fuel-rich combustion products, and the resultant mixture is maintained at a temperature of at least 1800° K. for a time sufficient to reduce the concentration of nitrogenous compounds a desired amount, forming primarily elemental gaseous nitrogen. In the aforesaid application, higher temperatures are preferred. A temperature range of from 1800° to 2500° K. is preferred.

When a calcium-containing inorganic alkaline absorbent is used in the sulfur capture zone of the present invention, calcium sulfide (CaS) is formed. When this calcium compound is passed to the nitrogenous compound destruction zone, it appears to greatly enhance the nitrogenous compound destruction process.

For most applications of the present invention, complete combustion of the fuel to obtain the maximum amount of heat is desired. In such instances, the mixture of fuel and combustion products discharged from the prior zone is passed into one or more subsequent combustion zones, during which time the temperature in such subsequent zones preferably is maintained within the range of from about 1800° to 2000° K. while sufficient additional air is introduced to provide from about 100% to 120% of the total stoichiometric amount of oxygen required for complete combustion of the fuel. Even if there is no sulfur in the fuel, this temperature range is preferred to simultaneously prevent formation of nitrogen oxides and yet allow complete oxidation of the remaining products of the earlier fuel-rich combustion.

PREFERRED EMBODIMENT

The present invention in its broadest aspects provides a method for the partial or complete oxidation of a sulfur-containing combustible fuel in one or more combustion zones with minimal or substantially reduced emission of gaseous sulfur compounds which normally are formed during combustion. In contrast to the methods and apparatus known heretofore, the present invention does not require high molar ratios of an inorganic alkaline absorbent to achieve substantial reduction in the emission of gaseous sulfur compounds. Indeed, in accordance with the present invention, molar ratios of inorganic alkaline absorbent to sulfur within the range of from about 1:1 to 3:1 are capable of providing a reduction in gaseous sulfur compound emission of 70% and higher. It is a particular advantage of the present invention that under the controlled conditions of stoichiometry and temperature described herein, the inorganic alkaline absorbents which may be present as constituents of the fuel ash will react efficiently with the fuel sulfur constituents to produce the desired, readily removable solid sulfur compounds, thus reducing the requirement for additional inorganic alkaline absorbent and reducing the subsequent waste disposal problem.

Figure 1:
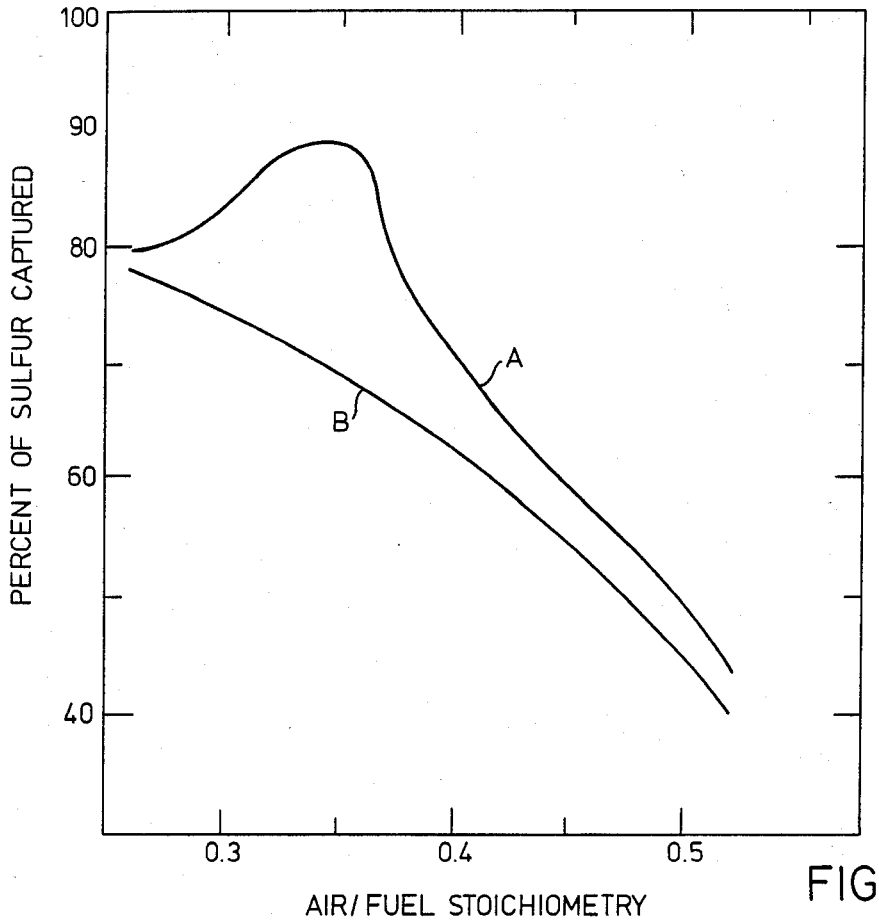
FIG. 1 is a graph depicting the percent of sulfur captured versus the air/fuel stoichiometry.

The present invention will now be particularly described with respect to a preferred embodiment, involving the complete oxidation of a sulfur-containing fuel, such as coal, in a plurality of zones, with substantially reduced emission of gaseous sulfur compounds as well as substantially reduced emission of oxides of nitrogen. Referring now to FIG. 1, therein is depicted a graph showing the percent of fuel sulfur captured versus air/fuel stoichiometry. The graph represents the results of two series of tests run to show the effect of air/fuel stoichiometry. Illinois No. 6 coal was combusted in the presence of lime, the lime being added in an amount to provide a molar ratio of two moles of lime per mole of sulfur in the fuel. Curve A was for a 6.0-ft-long combustor which provided a residence time of about 100 milliseconds Curve B was for a 12-ft-long combustor which provided a residence time of about 200 milliseconds.

The results of the test clearly demonstrate that within a narrow band of stoichiometry, it is possible to capture a substantial percentage of the fuel sulfur utilizing a relatively low molar ratio of absorbent to sulfur. Specifically, with an air/fuel stoichiometric ratio of from about 0.25 to 0.40, it is possible to reduce by 90% or more the gaseous sulfur compounds which otherwise would be emitted to the atmosphere. It will be appreciated that the test conditions yielding the data shown in FIG. 1 were not optimized; therefore, greater capture rates could be expected within these combustor lengths or residence times. It also will be appreciated that in all instances, it may not be desired or necessary to eliminate the emission of all of the gaseous sulfur compounds. For example, generally the emission requirements for low sulfur coals, such as Western coals, are only that 70% of the gaseous sulfur compounds be removed; whereas for the higher sulfur Eastern coals, the requirements are more stringent and 90% removal may be required. Accordingly, the residence times and molar ratios of absorbent to sulfur are readily selected to achieve the desired reduction in emission of gaseous sulfur compounds.

Figure 2:
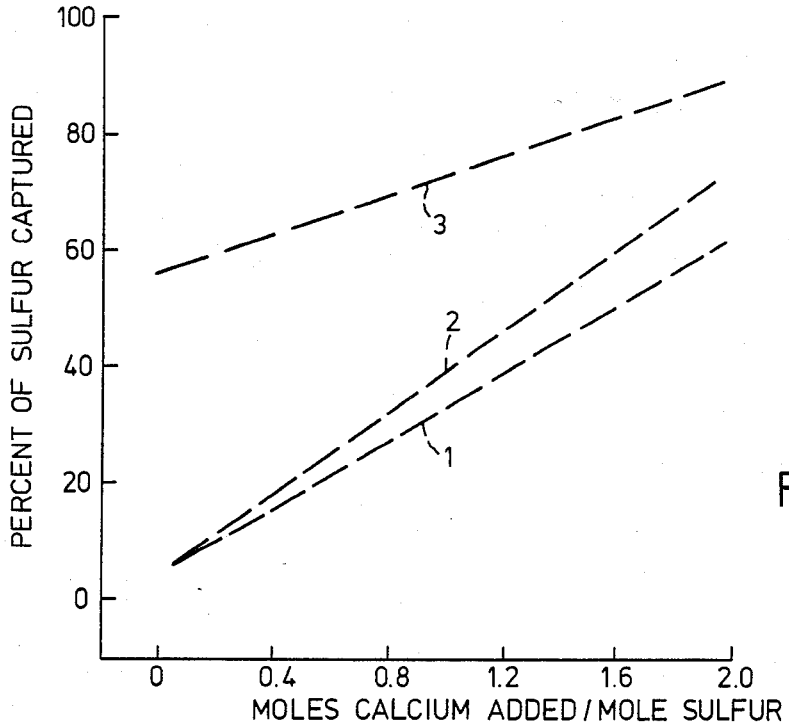
FIG. 2 is a graph depicting the percent of sulfur captured versus the moles of calcium added per mole of sulfur in the fuel.

Referring now to FIG. 2, therein is a graph depicting the percent of sulfur captured versus the moles of calcium added per mole of sulfur in the coal. As would be expected, the more calcium that is added, the higher is the percentage of sulfur that is captured. However, two significant features depicted here are the effect of different residence times and the effect of any inorganic alkaline absorbent contained in the coal. Specifically, lines 1 and 2 are typical plots for a low ash (negligible calcium content) Eastern coal. However, line 1 is for a coal combusted in a 6-ft combustor; and line 2 is for coal combusted in a 12-ft combustor, thus demonstrating the increased percent of sulfur captured by virtue of a longer residence time. Line 3 is for a Western coal, which contained 1.4 moles of calcium per mole of sulfur in the coal, combusted in a 6-ft combustor. From this it is seen that even with no calcium added, more than half of the sulfur was removed by the calcium in the ash. Many Western coals contain more than 2.0 moles of calcium per mole of sulfur. It will be appreciated, therefore, that by utilizing the proper stoichiometry, temperatures, and residence times, it is possible to combust Western coals and obtain all the sulfur capture presently required by the environmental laws with little or no additional calcium added to the coal.

High sulfur Eastern coals normally contain small concentrations of alkaline compounds and, therefore, nearly all of the inorganic alkaline absorbent necessary for the sulfur capture will have to be added. This additional absorbent preferably is ground into or otherwise intimately mixed with the fuel, to provide the same intimate fuel-absorbent contact provided by the alkaline compound normally contained in coal ash. In the tests yielding the data described by lines 1 and 2 in FIG. 2, lime was added to the coal before the coal was pulverized so that the lime was ground into the coal particles. It is generally preferred that the particle size of the inorganic alkaline absorbent added to the coal be the same as or smaller than that of the coal. An absorbent ground to a particle size where at least 70% passes through a 200-mesh screen (U.S. standard sieve size) is generally suitable.

Figure 3:
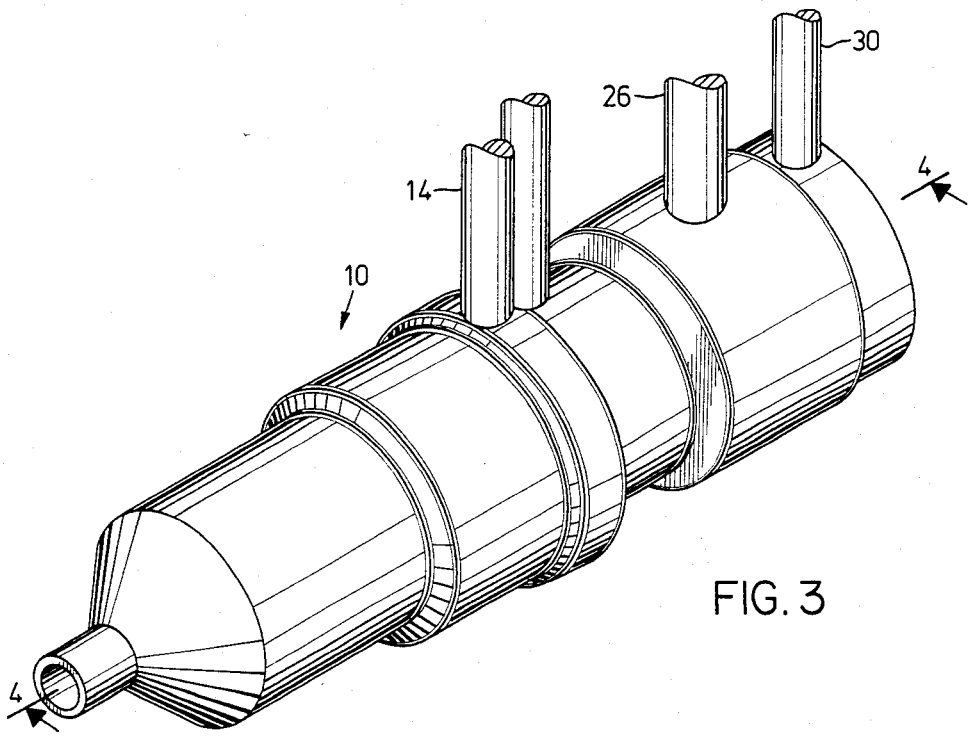
FIG. 3 is a perspective view of a three-zone burner utilized for the preferred practice of this invention.
Figure 4:
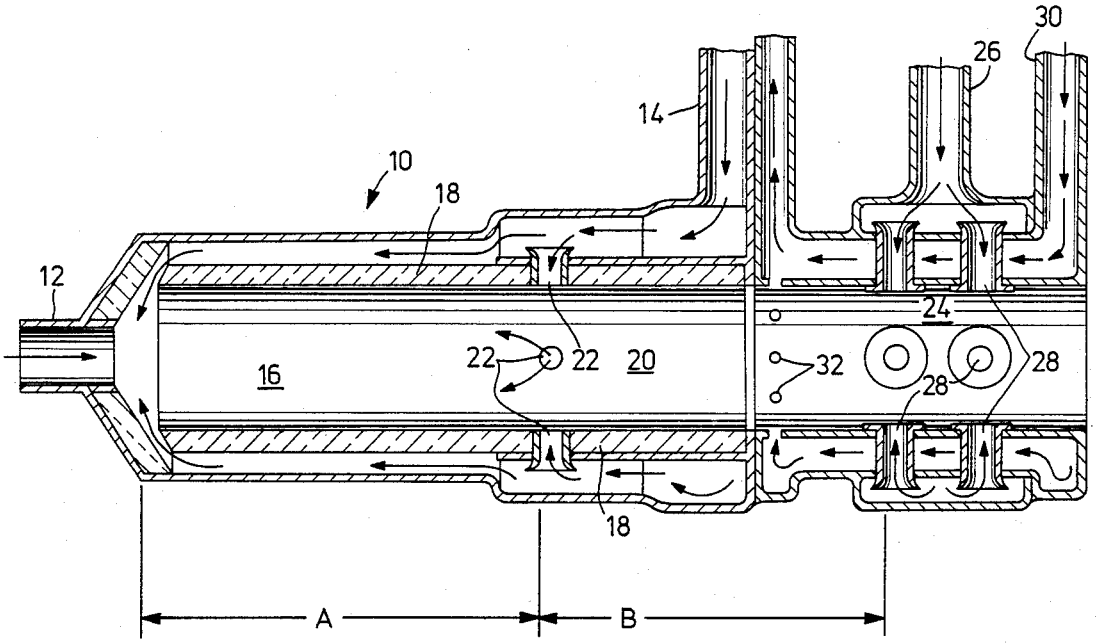
FIG. 4 is a schematic view in cross section taken along lines 4—4 of FIG. 3.

Referring now to FIG. 3, a perspective view of a burner assembly 10 utilized in the practice of the present invention is shown. A cross-sectional view of this burner assembly 10 is shown in FIG. 4. The term "burner" or "burner assembly" is used herein to refer to a device which brings together fuel and air, mixes these to form a combustible mixture, and partially completes the combustion to achieve the desired composition of combustion products. Although general usage is not consistent, the term "burner" generally is considered to refer primarily to that part of a combustion device which brings together fuel and air and prepares the mixture for combustion (for example, Bunsen Burner). The term "combustor" is generally considered to refer to the burner plus that part of the device in which combustion is completed (for example, a gas turbine combustor). Such terms as "furnace" and "boiler" are generally considered to include not only the combustor but also various end uses of the heat of combustion, none of which are considered to be specific features of this invention.

This invention is concerned with controlling combustion to the degree necessary to achieve low emissions of gaseous sulfur compounds in a wide variety of applications. In no application is it necessary to contain combustion within the device constructed to achieve this purpose until combustion has been completed, i.e., until all chemical species have been converted to the lowest energy state. In some applications, the desired combustion products might actually be the fuel rich gases resulting from partial combustion. For these reasons and because the unique apparatus developed to practice the present combustion process is intended to replace devices generally referred to as burners, the term "burner" as applied herein should be construed broadly in reference to such apparatus.

Referring again to FIG. 4, fuel is introduced into the burner assembly 10 through an inlet 12. The present invention is applicable to a wide variety of sulfur containing combustible fuels which produce gaseous sulfur compounds during combustion. Thus, the present invention is applicable to the various liquid sulfur-containing fuels, petroleum products and by-products such as the so-called bunker fuel oils and shale oil, as well as crude petroleum, petroleum residua, and various other petroleum by-products which may contain varying amounts of sulfur. In addition, the present invention also is applicable to normally solid fuels including asphalt, coal, coal tars, lignite, and even combustible municipal or organic.waste. Such solid fuels, particularly coal, are ordinarily pulverized and fed to the burner in suspension in a carrier gas, generally air. Any air present in the carrier gas will be included as a part of the stoichiometric air requirements for combustion of the fuel. The exemplary apparatus shown in FIGS. 3 and 4 is considered appropriate for the combustion of solid fuels such as coal.

Also introduced into the burner assembly is an inorganic alkaline absorbent for reaction with the gaseous sulfur compounds. In the preferred embodiment depicted, the inorganic alkaline absorbent is admixed with the coal and ground prior to introduction into the burner via inlet 12. Any inorganic alkaline absorbent which will react with the acidic sulfur compounds present in the fuel or formed during the initial stages of combustion may be utilized. The preferred inorganic alkaline absorbents, based on their availability and cost, are the oxides, hydroxides, and carbonates of magnesium, calcium, and sodium. These may be used either singly or in combination. Particularly preferred inorganic alkaline absorbents are the carbonates of calcium and sodium which may be obtained as a naturally occurring mineral in the form of limestone and soda ash, respectively. Limestone, for example, is introduced in an amount to provide a total molar ratio, including the inorganic calcium contained in the ash constituents of the fuel, within the range of from about 1 to 3 moles of calcium per mole of sulfur, and preferably within the range of from about 1.8 to 2.5 moles of calcium per mole of sulfur. It will be appreciated that many of the solid carbonaceous fuels contain significant amounts of an inorganic alkaline absorbent such as limestone in their ash constituents. It is an advantage of the present invention that the alkaline absorbent contained in the fuel will also react with the gaseous sulfur constituents. Accordingly, when the term "mole ratio" of absorbent to sulfur is referred to, it includes the inorganic alkaline portion of the fuel as well as any additional absorbent which may be introduced.

Also introduced into burner assembly 10 via an inlet 14 is a source of oxygen such as air, pure elemental oxygen, oxygen-enriched air, and the like. Generally, air is preferred in the interest of economy. The air, inorganic alkaline absorbent, and fuel are mixed with one another and reacted in a first combustion zone 16. It is, of course, an essential element of the present invention that the air and fuel be introduced in amounts to provide from about 25% to 40%, and preferably from 32% to 37%, of the stoichiometric amount of air (including any carrier air) required for complete oxidation of the fuel.

The temperature of the combustion products formed in combustion zone 16 must be sufficiently high to ensure gasification of the fuel and the fuel sulfur constituents. The upper temperature limit is dictated by economics and materials of construction and the necessity of avoiding such high temperatures as would result in decomposition of the solid sulfur compounds formed by the reaction between the gaseous sulfur compounds and the alkaline absorbent. Generally, the temperature is maintained within a range of from about 1000° to 1800° K., and preferably within a range of from about 1200°0 to 1600° K. Even within these particularly suitable and preferred temperature ranges, it may be necessary to provide protection for the walls of combustion zone 16 such as by providing a ceramic coating or lining 18, suitably of alumina or silicon carbide.

In accordance with the particularly preferred embodiment, the air introduced through inlet 14 preferably is preheated to a temperature of from about 500° to 800° K. to maintain the desired temperature in combustion zone 16. This preheated air is passed in heat exchange relationship with combustion zone 16 prior to entering the combustion zone. Thereby, this preheated air also serves to insulate the outer surfaces of burner assembly 10 from the high temperatures present in zone 16. However, numerous equivalent methods for providing heat to zone 16 will be readily apparent to those versed in the art. For purposes of economy, many combustion devices such as boilers normally heat the combustion air by heat exchange with the flue gases leaving the device. Alternatively, other types of direct or indirect heat exchangers or electric heating elements could be utilized to maintain the desired temperature.

Combustion zone 16 has a length A to provide the desired residence time for the products in that zone. The precise length will, of course, be a function of the residence time selected and the velocity of the flowing combustion products. The residence time required for efficient capture of the sulfur contained in solid or liquid fuels is largely governed by the time required to gasify a sufficient amount of the fuel to ensure gasification of substantially all of the sulfur in the fuel, and to ensure that the desired fuel-rich, gas-phase stoichiometry is provided. Depending upon the composition of the fuel and the sulfur within the fuel, the fuel's physical size and state, and the combustion conditions, the total residence time required to adequately gasify the fuel and provide sulfur capture can range from as low as 50 to as high as 600 milliseconds. For pulverized coal fired under the above conditions, stoichiometry, and reactive temperatures, residence times of 200 to 600 milliseconds generally are preferred. With liquid fuels, shorter residence times of from about 50 to 200 milliseconds generally are adequate. The particle size of the fuel affects the residence time required for gasification, coarser particle sizes increasing the required time. Conversely, finer particle sizes can substantially reduce the required time for gasification.

In accordance with the particularly preferred embodiment depicted, the combustion products leaving combustion zone 16 are introduced into a second combustion zone 20 for the destruction of nitrogenous compounds. As taught in the aforesaid issued U.S. Pat. No. 4,427,362, for effective destruction of nitrogenous compounds formed during combustion of the fuel, it is essential that the air and fuel be introduced in amounts to provide from 45% to 75%, and preferably from 50% to 65%, of the stoichiometric amount of oxygen required for complete oxidation of fuel. However, unless the solid sulfur compounds have been removed, in accordance with the present invention it is preferred that the stoichiometry in this combustion zone be maintained at less than that above which thermodynamics indicates oxidation of the solid sulfur compounds formed in the sulfur capture zone will occur. For a typical bituminous coal, the air introduced into this zone should be maintained to supply less than about 60% of the amount of oxygen required for complete oxidation of the fuel. Under these conditions, the temperatures necessary for rapid destruction of the nitrogenous compounds can be maintained throughout this zone without appreciable oxidation of the desired solid, sulfur compounds. As depicted in FIG. 4, the air for combustion zone 20 also is introduced through inlet 14 and through a plurality of openings 22.

The second combustion zone 20 has a length B which will generally be less than half that of first combustion zone 16 to provide an adequate residence time for the desired amount of destruction of nitrogenous compounds. When the $SO_x$ capture zone, the subject of this invention, is used in conjunction with an $NO_x$ destruction stage, most of the coal gasification is accomplished in the $SO_x$ capture zone. Therefore, residence time in the $NO_x$ destruction stage, and the length of that zone, can be very short. For most applications, residence times between about 25 and 100 milliseconds are adequate to achieve nitrogenous compound levels of less than about 50 parts per million.

As further taught in the aforementioned issued U.S. Pat. No. 4,427,362, the presence of particulate materials such as soot, char, coke, and iron compounds have been noted to greatly enhance the rate of destruction of nitrogenous compounds. When these are present in the ash constituents of a fuel such as coal, there is no need to add any additional particulates. However, if the fuel is a low ash fuel, it may be advantageous to add such finely dispersed particulates to reduce the residence time which would otherwise be required. If these particulates are introduced into the burner with the fuel in the $SO_x$ capture stage, then particulates, including the solid sulfur-containing compounds, should not be removed from the gas stream until the desired $NO_x$ destruction is achieved. In certain applications, however, the required residence time for $NO_x$ destruction may be so short that little practical advantage is obtained if particles are not used to accelerate $NO_x$ destruction. In such cases, it may be advantageous to remove the solid, sulfur compounds prior to the addition of any further combustion air to eliminate the possibility of dissociation of the solid, sulfur compounds in subsequent combustion zones.

In the preferred embodiment, the combustion products leave combustion zone 20 and enter at least a third combustion zone 24. As taught in the aforementioned application, additional combustion air is supplied to combustion zone 24 via an inlet 26 and openings 28 to complete combustion of the fuel-rich gases. An essential feature of the temperature regime for this final combustion stage is that the temperature be maintained at least below that at which substantial amounts of thermal $NO_x$ will be formed. In the preferred embodiment of this invention, the solid sulfur compounds generated in the first sulfur-capture combustion zone, are retained in the combustion gases and, therefore, must pass through this third combustion zone 24. The temperature in this zone must be as low as possible, compatible with rapid completion of combustion of the fuel-rich gases. To both minimize $NO_x$ formation and decomposition of the solid, sulfur compounds, and yet complete combustion, the temperature in combustion zone 24 is maintained between 1600° and 2000° K., and preferably between 1800° and 1900° K.

In the example where limestone is the inorganic alkaline absorbent used to capture the sulfur, the solid, sulfur-bearing compound will be calcium sulfide, CaS. It is well known that, for stoichiometric mixtures above about 60% of theoretical air, the CaS, in the solid particulate form, will readily oxidize to $CaSO_4$ while remaining a solid. This rapid, highly exothermic reaction is kinetically favored over oxidation to gaseous sulfur oxides. Further oxidation is not possible; thus, at high temperatures, the calcium sulfate ($CaSO_4$), unless otherwise inhibited, will begin to decompose to CaO and $SO_2$, in a slower, highly endothermic reaction. The literature shows that relatively rapid decomposition of pure $CaSO_4$ begins at temperatures of about 1520° K., well below the 1600° to 2000° K. required, to complete the combustion of the fuel-rich gases entering zone 24 from zone 20. While this would appear to preclude retention of the sulfur in a solid, easily removable form through zone 24, experiments under controlled conditions show that retentions of from 50 to 90% or more are readily achieved in practice.

The inventor does not know with certainty, and does not wish to be bound by any theoretical explanation of, the underlying mechanisms involved in retention of the solid sulfur compounds through this final combustion zone. However, the following explanation is offered. As an example, the case where limestone is used initially to capture the sulfur in coal will be discussed. The limestone involved in the initial sulfur capture is either already intimately mixed with the coal, as a naturally occurring mineral constituent, or, when added, is preferably mixed with the coal, by grinding or other means. Thus, the initial sulfur capture is thought to occur within, or on the surface of a burning coal particle. Early in the combustion process and at low temperatures the limestone is decarboxylated, freeing the $CO_2$ and leaving a highly active, solid CaO. As the fuel sulfur is gasified (primarily to $H_2S$) at the required low stoichiometry, the sulfur-containing gas rapidly reduces the solid CaO to CaS. Thus, the sulfur is captured, or retained, within and on the surface of, the burning coal particle, where the local stoichiometry is fuel-rich and temperatures are quite low. As the coal particle gasification and burning proceeds, the CaS remains as an intimate mixture within and on the remaining char or fly ash. Oxidation of the CaS to $CaSO_4$ or to CaO, then, must be accomplished by oxygen or an oxygen-containing species diffusing to the burning particle. Such oxygen is not available in either the sulfur capture or $NO_x$ destruction zones, particularly in the very fuel-rich local region within and on the surface of the particle; thus, the CaS form is thermodynamically favored. Even when the final combustion air is added in combustion zone 24, residual particle burning must be substantially complete before oxygen can reach the particle surface in appreciable quantities. Thus, it is only in the final stages of particle burnout that oxidation of the CaS to $CaSO_4$ and subsequent decomposition to gaseous sulfur species can begin. This process is slow, being inhibited by: (1) diffusion of oxygen into the pores of the particle, to contact the CaS fixed within the particle; (2) the presence of some residual carbon, which preferentially reacts with the oxygen; (3) the endothermic nature and slow kinetics of the decomposition reactions; and (4) the tendency of the calcium and magnesium compounds to "dead burn", i.e., to close or plug up the particle pores and to form an impervious layer on the surfaces of the particle.

Thus, the preferred approach utilized in this invention to retain the solid, sulfur compounds throughout the remaining combustion is to: (1) cool the combustion gases leaving the $NO_x$ destruction zone to about 1600° to 1800° K. prior to or simultaneously with the addition of the final combustion air; (2) provide for rapid mixing of this final combustion air with the fuel-rich combustion products coming from the $NO_x$ destruction stage, prior to complete carbon burnout, to rapidly pass through the maximum combustion temperature associated with stoichiometric mixtures while some residual carbon remains in the particle; and (3) use subsequent continued gas cooling, by the boiler itself, to reduce the gas and particle temperatures finally below the 1520° K. $CaSO_4$ decomposition temperature. The above approach is entirely compatible with the final combustion zone requirements to prevent formation of $NO_x$ in this final stage and yet complete combustion of the fuel-rich gases from the $NO_x$ destruction stage, as described in the aforementioned pending patent application. Therefore, the preferred embodiment of this invention, to be used in conjunction with the process described in the aforementioned patent application, automatically provides the final combustion zone conditions necessary to optimize retention of the solid, sulfur compounds throughout the fuel combustion.

Cooling of the combustion products leaving the earlier combustion zone prior to the introduction of the additional combustion air for final combustion may be accomplished in various manners known to those versed in the art. For example, the gases may be cooled by passing them in indirect heat exchange relationship with a cooling fluid introduced through an inlet 30 of burner assembly 10. In addition or alternatively thereto, a coolant fluid can be introduced directly into the hot gases via nozzles 32. Still further, the combustion air introduced through inlet 26 can be cooled and diluted with an inert gas such as recirculated flue gas to absorb the heat or the like. These and numerous other techniques will be readily apparent to those versed in the art.

Once the hot gaseous combustion products leave the burner and the desired amount of thermal energy has subsequently been extracted from the combustion products, the gases are readily discharged to the atmosphere with substantially reduced pollutant effect. Specifically, in accordance with the present invention, it is possible to burn substantially any sulfur-containing combustible fuel, generally a fossil fuel, and discharge a product or waste gas containing less than 10% of the gaseous sulfur compounds which would otherwise be present, and in accordance with a particularly preferred embodiment, containing less than 50 ppm of oxides of nitrogen. It also is a particular advantage of the present invention that it may be practiced with a relatively compact burner assembly which is suitable as a retrofit for utility boiler application and other existing facilities wherein sulfur-containing fuels are burned for the principal purpose of producing heat.

The following examples will serve to more fully describe the practice of the present invention. It is to be understood, however, that these examples are not intended to limit the scope of the invention, but rather are presented for illustrative purposes.

The following experiments were performed on an apparatus similar to that shown in FIGS. 3 and 4. The coal was ground such that at least 70% of it would pass through a 200-mesh (U.S. standard sieve size) screen. The ground coal was injected in dense phase feed (1.0 lb./cu.ft.) into a combustion chamber having an internal surface to volume ratio of approximately 0.26 $cm^{-1}$. Heated air (590° K.) was simultaneously admitted through an injection and mixing device known as a pentad injector. In such an injector, four circumferentially located streams of air impinge on a centrally located stream of pulverized coal at an included angle of about 30 degrees. The combustion pressure was approximately 6 atmospheres. Three different combustor configurations were utilized. One configuration comprised a 1.83 meter (6 ft.) long-combustor having a 0.152 meter diameter that provided a residence time of approximately 90 milliseconds. The second configuration had the same diameter and a length of 3.66 meters (12 ft.) to provide an approximate residence time of 180 milliseconds. The third configuration used the second configuration with the addition of a slag separator that added approximately 45 milliseconds of residence time for a total residence time of about 255 milliseconds.

The combustion products were monitored for gaseous sulfur compounds as they exited the end of the combustor. The percent fuel sulfur captured was calculated from the difference between the measured concentration of all gaseous sulfur species in the combustion gases and the gaseous sulfur species concentration that would theoretically be present if none were captured in the solid form.

$$\% \text{ capture} = \frac{\text{Theoretical} - \text{measured}}{\text{Theoretical}} \times 100$$

This method correctly represents sulfur captured provided that a sufficient amount of the coal has been gasified to ensure that essentially all of the sulfur constituents in the coal which are not captured by the absorbent are in the gaseous phase. Extensive data from this, and other ongoing coal treatment programs, indicate that more than 90 percent of the sulfur will be gasified whenever about 75% or more of the carbon content of the coal is gasified.

Compositions of the various coals tested are given in Table 1 below.

TABLE 1

COALS TESTED
Ultimate Analyses (Dry)

| | Eastern Coal Illinois No. 6 | Western Coal Kaiparowits |
|---|---|---|
| Carbon | 67.0 wt. % | 71.1 wt. % |
| Hydrogen | 5.2 | 5.0 |
| Nitrogen | 1.2 | 1.4 |
| Sulfur | 3.9 | 0.5 |
| Oxygen | 5.0 | 13.8 |
| Ash | 17.7 | 8.2 |
| Heating Value, Btu/Lb. | 11,440 | 12,470 |
| Calcium/Sulfur Mole Ratio (as received) | 0.9 | 2.0 |

EXAMPLE 1

Sulfur Capture Using Short Residence Time

Residence Time of approximately 90 milliseconds Illinois #6 Coal

| Test No. | Calcium/ Sulfur Mole Ratio* | Stoichiometric Ratio (Fraction of Theoretical Air) | Sulfur Capture (%) | Measured Combustion Gas Temp. (°K.) | Inlet Air Temp. (°K.) |
|---|---|---|---|---|---|
| 1 | 0.09 | 0.40 | 16.7 | 1428 | 593 |
| 2 | 0.09 | 0.48 | 12.1 | 1561 | 593 |
| 3 | 0.09 | 0.55 | 16.1 | 1537 | 593 |
| 4 | 2.00 | 0.28 | 70.7 | 1369 | 596 |
| 5 | 2.00 | 0.28 | 67.3 | 1374 | 597 |
| 6 | 2.00 | 0.33 | 72.9 | 1595 | 596 |
| 7 | 2.00 | 0.35 | 70.7 | 1566 | 599 |
| 8 | 2.00 | 0.39 | 54.6 | — | 598 |
| 9 | 2.00 | 0.39 | 51.4 | 1437 | 599 |
| 10 | 2.00 | 0.40 | 53.2 | — | 597 |
| 11 | 2.00 | 0.46 | 68.9 | 1479 | 450 |
| 12 | 2.00 | 0.54 | 10.3 | 1564 | 599 |
| 13 | 2.00 | 0.60 | 50.0 | — | 452 |

*Calcium/sulfur mole ratio of 0.09 occurs naturally; adjustment to 2.00 was made by mechanical mixing of powdered CaO (70% through a 200-mesh sieve) into the ground coal.

Extensive data from this and other coal treatment programs indicate that 75% gasification of the carbon content of the coal may not be obtained at air/coal stoichiometric ratios of less than about 0.4 under the conditions shown in Example 1, i.e., residence time, particle size and temperature. Further, no data were obtained in this Example 1 to ascertain the exact amount of gasification obtained; thus, a few of the data points might be questioned. However, it is believed the overall test results can be relied upon to show a general trend toward high sulfur capture within the desired conditions of stoichiometry and temperature even at this short residence time (for coal).

EXAMPLE 2

Sulfur Capture With Longer Residence Time

Residence Time of approximately 180 milliseconds Illinois #6 Coal

| Test No. | Calcium/ Sulfur Mole Ratio* | Stoichiometric Ratio (Fraction of Theoretical Air) | Sulfur Capture (%) | Measured Combustion Gas Temp. (°K.) | Inlet Air Temp. (°K.) |
|---|---|---|---|---|---|
| 1 | 0.09 | 0.43 | 14.6 | 1437 | 598 |
| 2 | 0.09 | 0.47 | 18.1 | 1531 | 597 |
| 3 | 0.09 | 0.48 | 14.9 | 1489 | 596 |
| 4 | 0.09 | 0.54 | 4.1 | 1519 | 598 |
| 5 | 2.00 | 0.28 | 73.5 | 1373 | 599 |
| 6 | 2.00 | 0.28 | 70.7 | 1372 | 598 |
| 7 | 2.00 | 0.36 | 90.0 | 1411 | 594 |
| 8 | 2.00 | 0.39 | 69.9 | — | 594 |
| 9 | 2.00 | 0.45 | 50.3 | 1514 | 597 |
| 10 | 2.00 | 0.46 | 80.4 | — | 450 |
| 11 | 2.00 | 0.52 | 34.1 | 1622 | 598 |
| 12 | 2.00 | 0.66 | 37.8 | — | 452 |

*Calcium/sulfur ratio of 0.09 occurs naturally; adjustment to 2.00 was made by mechanical mixing of CaO powder into the coal.

This example demonstrates the benefit of a longer residence time within the desired conditions of stoichiometry and temperature. Specifically, referring to Example 1, Test 7, it is seen that for a 90-millisecond residence time and a stoichiometry of 0.35, 70.7% of the sulfur was captured. In this Example 2, Test 7, with substantially the same conditions, except that longer residence time (180 milliseconds) was used, 90% of the sulfur was captured. In addition, when using the longer residence time, in excess of 75% of the carbon content of the coal was consistently gasified.

Thus, the foregoing Example 2, using a longer residence time, demonstrates that within the claimed range of stoichiometry and preferred temperature range, substantial sulfur capture is consistently obtained. This is in contrast to recently issued U.S. Pat. No. 4,285,283 (Lyon et al.) which teaches that, with similar stoichiometries and temperatures, significant sulfur capture can only be obtained by using an organic calcium compound. To further demonstrate the criticality of using organic calcium, rather than physical mixtures of coal and solid inorganic calcium, patentees describe "Comparative Example B" in which a physical mixture of powdered coal and powdered limestone was prepared such that the ratio of calcium to sulfur for the mixture was 3.5. This mixture was burned in two stages by flowing a suspension of the mixture in air at near atmospheric pressure downwardly through an alumina tube in an electric furnace. In the first stage an equivalence ratio of 3 (stoichiometric air/fuel ratio of 0.33) and a reaction time of 1.5 seconds was used. Poor fuel utilization and also poor sulfur retention in the recovered solids were reported. It is noted that patentees utilized a temperature of 1500° C. (1773° K.), which is higher than that preferred in the practice of the present invention.

The explanation for the results reported by patentees in Comparative Example B is not known. However, it has been reported that in tests performed at 1223° K., limestone and dolomite in relatively large sizes (5–6 mm diameter) effectively stop reacting with $H_2S$ after about 60% of its mass has been reacted. This has been assumed to be due to the formation of a relatively non-porous ash on the surface of the particles. (See Squires et al., "Desulfurization of Fuels with Calcined Dolomite. 1. Introduction and First Kinetic Results," *Chem.Eng.Progr.Symp.Series* No. 115, Vol. 67, 1971; AIChE, New York.)

By way of contrast, in the foregoing Example 2 it is seen that with a low calcium to sulfur ratio (0.09) the sulfur capture was correspondingly low. However, when enough inorganic calcium (as lime) was added to provide a mole ratio of calcium to sulfur of 2.0, greatly enhanced sulfur capture was obtained within the indicated range of stoichiometry and temperature for a residence time of 180 milliseconds. Accordingly, if limestone or dolomite is used as the inorganic alkaline absorbent, it will be used within the preferred temperature range of from about 1200° to 1600° K.

EXAMPLE 3

Sulfur Capture With Western Coal

Residence Time of approximately 225 milliseconds Kaiparowits Coal

| Test No. | Calcium/ Sulfur Mole Ratio | Stoichiometric Ratio (Fraction of Theoretical Air) | Sulfur Capture (%) | Measured Combustion Gas Temp. (°K.) | Inlet Air Temp. (°K.) |
|---|---|---|---|---|---|
| 1 | 2.0 | 0.533 | 52.3 | * | 612 |
| 2 | 2.0 | 0.673 | 61.3 | * | 613 |
| 3 | 2.0 | 0.660 | 40.0 | * | 611 |
| 4 | 2.0 | 0.687 | 53.7 | * | 617 |
| 5 | 2.0 | 0.687 | 49.6 | * | 618 |
| 6 | 2.0 | 0.683 | 57.9 | * | 616 |
| 7 | 2.0 | 0.698 | 38.4 | 1431 | 614 |
| 8 | 2.0 | 0.319 | 97.4 | 1311 | 613 |
| 9 | 2.0 | 0.619 | 41.0 | 1339 | 616 |
| 10 | 2.0 | 0.619 | 59.3 | 1450 | 617 |
| 11 | 2.0 | 0.625 | 56.8 | 1478 | 609 |
| 12 | 2.0 | 0.629 | 58.3 | * | 621 |
| 13 | 2.0 | 0.625 | 52.5 | * | 617 |

*No measurement obtained.

It will be noted that only Test No. 8 of the above tests was within the claimed range of stoichiometry. Test No. 8, with 97.4% sulfur capture, was clearly superior to the other test results.

It is believed that the foregoing examples clearly demonstrate the efficacy of the present invention to capture substantial quantities of the sulfur constituents of a fuel, using an inorganic alkaline absorbent within certain limits of stoichiometry, temperature and residence time. It will be noted that certain data points indicate higher sulfur capture than would be expected from the general trend of the results obtained (see Tests 11 and 13 of Example 1 and Tests 10 and 12 of Example 2). It is not understood why these somewhat anomalous results occurred. Nonetheless, the overall data clearly indicate the trend for enhanced sulfur capture within the claimed range of stoichiometry.

The foregoing description illustrates a specific embodiment of the invention and what is now considered to be the best mode of practicing it. Those skilled in the art, however, will understand that changes may be made in the form of the invention without departing from its generally broad scope. Specifically, while the invention has been described, among other things, with respect to utilization of an entrained flow combustor utilizing three combustion zones, it will be readily apparent that fewer or more combustion zones could be utilized. Alternatively, any other combustion apparatus could be used, such as a fluidized bed combustor which normally will be operated at the lower end of the temperature range and utilize longer residence times than herein described. In some instances, it may be desirable to remove the solid sulfur compounds formed in the sulfur capture zone prior to the final conbustion of the fuel. In addition, the final combustion can be effected in a single zone as herein described. Alternatively, of course, the final combustion air may be added in multiple zones. It is within the scooe of the present invention, and indeed a preferred application, that when the solid sulfur compounds are left in the combustion gases, a major portion of the final combustion zone would be, for example, the fire box or fire tubes of a boiler wherein heat is drawn off during final mixing and combustion with the final combustion air. These and numerous other variations will be readily apparent to those versed in the art. Accordingly, it should be understood that within the scope of the appended claims the invention may be practiced otherwise than as specifically illustrated and described.

What is claimed is:

1. A method for the entrained flow combustion of a carbon- and sulfur-containing fuel for substantially reducing emission of gaseous sulfur compounds formed during the combustion of the fuel with a substoichiometric amount of oxygen, comprising:

introducing said fuel, an inorganic alkaline absorbent and an oxygen-containing gas into a first combustion sulfur capture zone of an entrained-flow combustor to form a fluent mixture therein of fuel and absorbent entrained in said gas, the oxygen being present in said zone in an amount to provide from about 25% to 40% of the total stoichiometric amount required for complete combustion of the fuel, the inorganic alkaline absorbent being present in an amount to provide a molar ratio of alkaline absorbent to sulfur compounds of from about 1.0:1 to 3.0:1, said ratio including any alkaline absorbents contained in the fuel;

reacting said fuel and absorbent entrained in said oxygen-containing gas by maintaining them in said zone at a temperature of from about 1000° to 1800° K. for a time sufficient (a) to gasify at least about 75% of the carbon content of the fuel and substantially all of the sulfur in the fuel, (b) to combust the gasified fuel and oxygen to produce a fuel-rich stoichiometry in the gas phase, and (c) to react in excess of about 70% of the fuel sulfur with the inorganic alkaline absorbent to form a solid alkaline sulfide compound; and discharging the resultant combustion mixture having a substantially reduced gaseous sulfur compound content.

2. The method of claim 1 wherein said alkaline absorbent is selected from the group consisting of the oxides, hydroxides, and carbonates of magnesium, calcium, and sodium, and said temperature is maintained within the range of from about 1200° to 1600° K.

3. The method of claim 2 wherein said alkaline absorbent is lime.

4. The method of claim 2 wherein said oxygen is introduced in an amount to provide from about 32% to 37% of said total stoichiometric amount.

5. The method of claim 1 wherein said temperature is maintained by preheating said oxygen-containing gas.

6. The method of claim 1 wherein said temperature is from about 1200° to 1600° K. and said time is from about 50 to 600 milliseconds.

7. The method of claim 1 wherein said fuel is a solid carbonaceous fuel selected from the group consisting of asphalt, coal, coal tars, lignite, and petroleum by-products which are solid at ambient temperatures.

8. The method of claim 7 wherein said time is from about 200 to 600 milliseconds.

9. The method of claim 1 wherein said fuel is selected from the group consisting of crude petroleum, petroleum residua, and petroleum by-products and said fuel is introduced as a liquid.

10. The method of claim 9 wherein said time is from about 50 to 200 milliseconds.

11. The method of claim 1 wherein said alkaline absorbent is present in an amount to provide a molar ratio of alkaline absorbent to sulfur compounds of about 2:1.

* * * * *